US008052267B2

(12) United States Patent
Amesbury

(10) Patent No.: US 8,052,267 B2
(45) Date of Patent: Nov. 8, 2011

(54) INLET STRUCTURE AND ASSEMBLY METHOD

(75) Inventor: Marjan Amesbury, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 567 days.

(21) Appl. No.: 12/241,314

(22) Filed: Sep. 30, 2008

(65) Prior Publication Data

US 2009/0278903 A1 Nov. 12, 2009

Related U.S. Application Data

(60) Provisional application No. 61/052,348, filed on May 12, 2008.

(51) Int. Cl.
*B41J 2/175* (2006.01)

(52) U.S. Cl. ..... 347/93; 347/84; 347/86

(58) Field of Classification Search ..... None
See application file for complete search history.

(56) References Cited

U.S. PATENT DOCUMENTS

2004/0257412 A1* 12/2004 Anderson et al. ..... 347/85
2006/0227182 A1* 10/2006 Greer et al. ..... 347/85

* cited by examiner

*Primary Examiner* — Matthew Luu
*Assistant Examiner* — Erica Lin

(57) ABSTRACT

In one embodiment, a fluid ejector assembly includes: an inlet structure having an opening therein through which fluid may enter the assembly, the inlet structure having a rim generally defining an outer perimeter of the inlet structure around the opening; a conduit through which fluid may pass from the opening in the inlet structure to an ejector structure; and a filter supported on the inlet structure and spanning the opening such that fluid passing through the opening in the inlet structure to the conduit passes through the filter, a peripheral edge of the filter surrounded by the rim of the inlet structure and the peripheral edge of the filter encapsulated by the inlet structure.

20 Claims, 9 Drawing Sheets

INLET STRUCTURE AND ASSEMBLY METHOD

This application claims the benefit of U.S. Provisional patent application Ser. No. 61/052,348 filed on 12 May 2008, which is hereby incorporated by reference in its entirety.

BACKGROUND

Inkjet printers typically utilize a printhead that includes an array of orifices (also called nozzles) through which ink is ejected on to paper or other print media. One or more printheads may be mounted on a movable carriage that traverses back and forth across the width of the paper feeding through the printer, or the printhead(s) may remain stationary during printing operations, as in a page width array of printheads. A printhead may be an integral part of an ink cartridge or part of a discrete assembly to which ink is supplied from a separate, often detachable ink container. For printhead assemblies that utilize detachable ink containers, it is important that the operative fluid connection between the outlet of the ink container and the inlet to the printhead assembly, commonly referred to as a fluid interconnection or "FI", provide reliable ink flow from the container to the printhead assembly.

Ink is drawn from the ink container through a filter on the inlet to the printhead assembly. The inlet to the printhead assembly is commonly referred to as an inlet "tower" because it usually extends out from the surrounding structure. Poor contact between the wick at the outlet of the ink container and the filter at the inlet tower may impede proper ink flow. Air leaking into the printhead assembly at this fluid interconnection may also impede ink flow. Thus, it is desirable to protect the filter from damage that can occur during repeated installations and removals of the ink containers.

The inlet tower structure for a printhead assembly is usually assembled by staking a stainless steel mesh filter onto the top of the tower. The exposed edges of the filter, which may contain loose fibers where the filter is punched or otherwise cut from a sheet of fabric mesh, is particularly susceptible to damage. To prevent the edge of the filter from coming into direct contact with the outlet/snout on the ink container, and thus help prevent damage to the filter, the peripheral edge of the filter may be recessed into the tower so that the rim of the tower is significantly higher than the edge of the filter. It was thought that the higher tower rim would protect the filter from damaging contact with the container outlet. However, it has been observed that this recessed filter design cannot be relied on to protect the filter from damage while still allowing a robust fluid interconnection. If the rim is too high with respect to the filter, then the rim may prevent the wick in the container outlet from making full contact with the filter. If the rim is too low, then the edge of the filter may be exposed to the container outlet, creating a risk of damage during installation and removal of the container.

DRAWINGS

FIG. 8 is a detail view illustrating of a portion of the inlet structure after a first operation shown in FIG. 7 in which the edge of the filter is staked to the inlet structure.

FIG. 10 is a detail view illustrating of a portion of the inlet structure after a second operation shown in FIG. 9 in which the edge of the filter is encapsulated in the rim of the inlet structure.

DESCRIPTION

Embodiments of the disclosure were developed in an effort to improve the fluid interconnection between a printhead assembly and a detachable/replaceable ink container—to construct a fluid interconnection providing a robust, reliable filter ink flow interface throughout repeated installations and removals of the ink container. Embodiments will be described, therefore, with reference to an inkjet printhead assembly that holds detachable/replaceable ink containers. Embodiments of the disclosure, however, are not limited to such implementations. Embodiments of the disclosure, for example, might also be implemented in other types of ink or fluid dispensing components. The example embodiments shown in the Figures and described below, therefore, illustrate but do not limit the scope of the disclosure.

Figure 1:
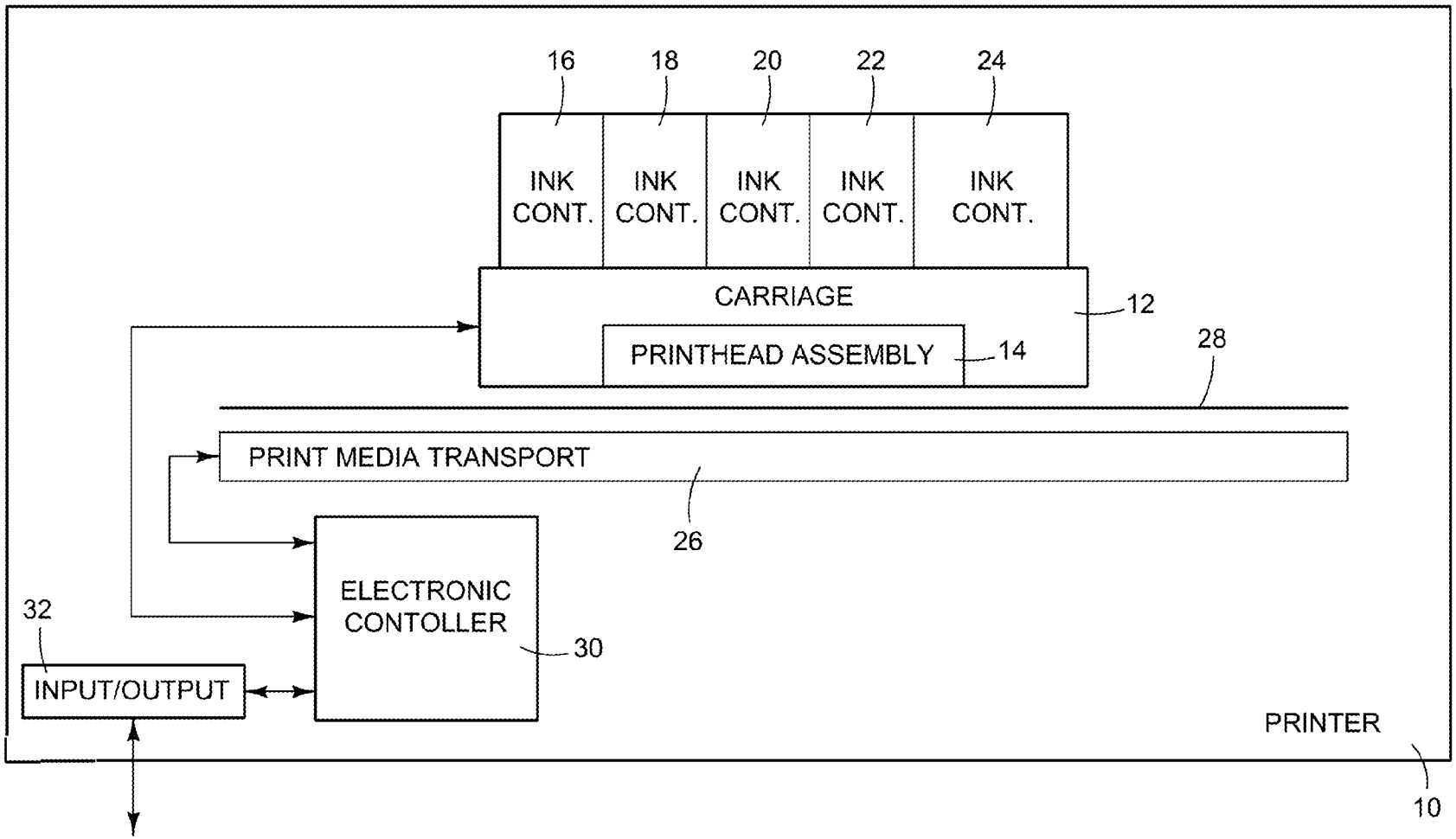
FIG. 1 is a block diagram illustrating one embodiment of an inkjet printer.

FIG. 1 is a block diagram illustrating an inkjet printer 10 in which embodiments of the disclosure may be implemented. Referring to FIG. 1, printer 10 includes a carriage 12 carrying a printhead assembly 14 and detachable ink containers 16, 18, 20, 22, and 24. Inkjet printer 10 and printhead assembly 14 represent more generally a fluid-jet precision dispensing device and fluid ejector assembly for precisely dispensing a fluid, such as ink, as described in more detail below. Printhead assembly 14 includes a printhead (not shown) through which ink from one or more containers 16-24 is ejected. For example, printhead assembly 14 may include two printheads—one for a series of color containers 16-22 and one for a black ink container 24. An inkjet printhead is typically a small electromechanical assembly that contains an array of miniature thermal, piezoelectric or other devices that are energized or activated to eject small droplets of ink out of an associated array of orifices. A typical thermal inkjet printhead, for example, includes a orifice plate arrayed with ink ejection orifices and firing resistors formed on an integrated circuit chip.

A print media transport mechanism 26 advances print media 28 past carriage 12 and printhead assembly 14. For a stationary carriage 12, media transport 26 may advance media 28 continuously past carriage 12. For a movable, scanning carriage 12, media transport 26 may advance media 28 incrementally past carriage 12, stopping as each swath is printed and then advancing media 28 for printing the next swath.

An electronic controller 30 is operatively connected to a moveable, scanning carriage 12, printhead assembly 14 and media transport 26. Controller 30 communicates with external devices through an input/output device 32, including receiving print data for inkjet imaging. The presence of an input/output device 32, however, does not preclude the operation of printer 10 as a stand alone unit. Controller 30 controls the movement of carriage 12 and media transport 26. Controller 30 is electrically connected to each printhead in printhead assembly 14 to selectively energize the firing resistors, for example, to eject ink drops on to media 28. By coordinating the relative position of carriage 12 with media 28 and the ejection of ink drops, controller 30 produces the desired image on media 28.

While this Description is at least substantially presented herein to inkjet-printing devices that eject ink onto media, those of ordinary skill within the art can appreciate that embodiments of the present disclosure are more generally not so limited. In general, embodiments of the present disclosure pertain to any type of fluid-jet precision dispensing device or ejector assembly for dispensing a substantially liquid fluid. The fluid-jet precision dispensing device precisely prints or dispenses a substantially liquid fluid in that the latter is not substantially or primarily composed of gases such as air. Examples of such substantially liquid fluids include inks in the case of inkjet printing devices. Other examples of substantially liquid fluids include drugs, cellular products, organisms, chemicals, fuel, and so on, which are not substantially or primarily composed of gases such as air and other types of gases. Therefore, while the Description is described in relation to an inkjet printer and inkjet printhead assembly for ejecting ink onto media, embodiments of the present disclosure more generally pertain to any type of fluid-jet precision dispensing device or fluid ejector structure for dispensing a substantially liquid fluid.

Figure 2:
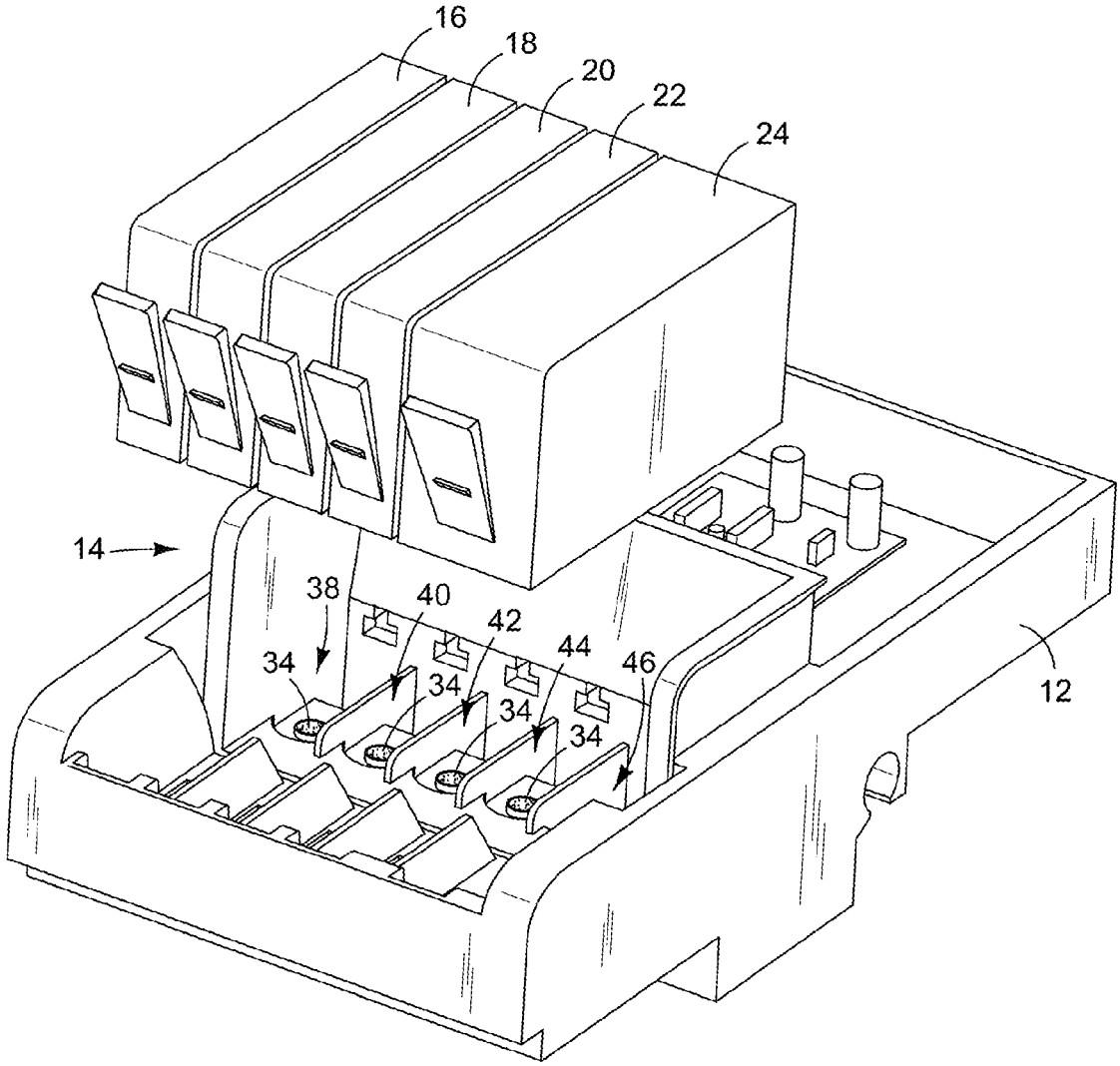
FIGS. 2 and 3 are perspective views of an embodiment of a carriage and printhead assembly, such as might be used in the printer of FIG. 1, with the ink containers exploded out from the carriage to show the inlets to the printhead assembly (FIG. 2) and the outlets from the ink containers (FIG. 3).
Figure 3:
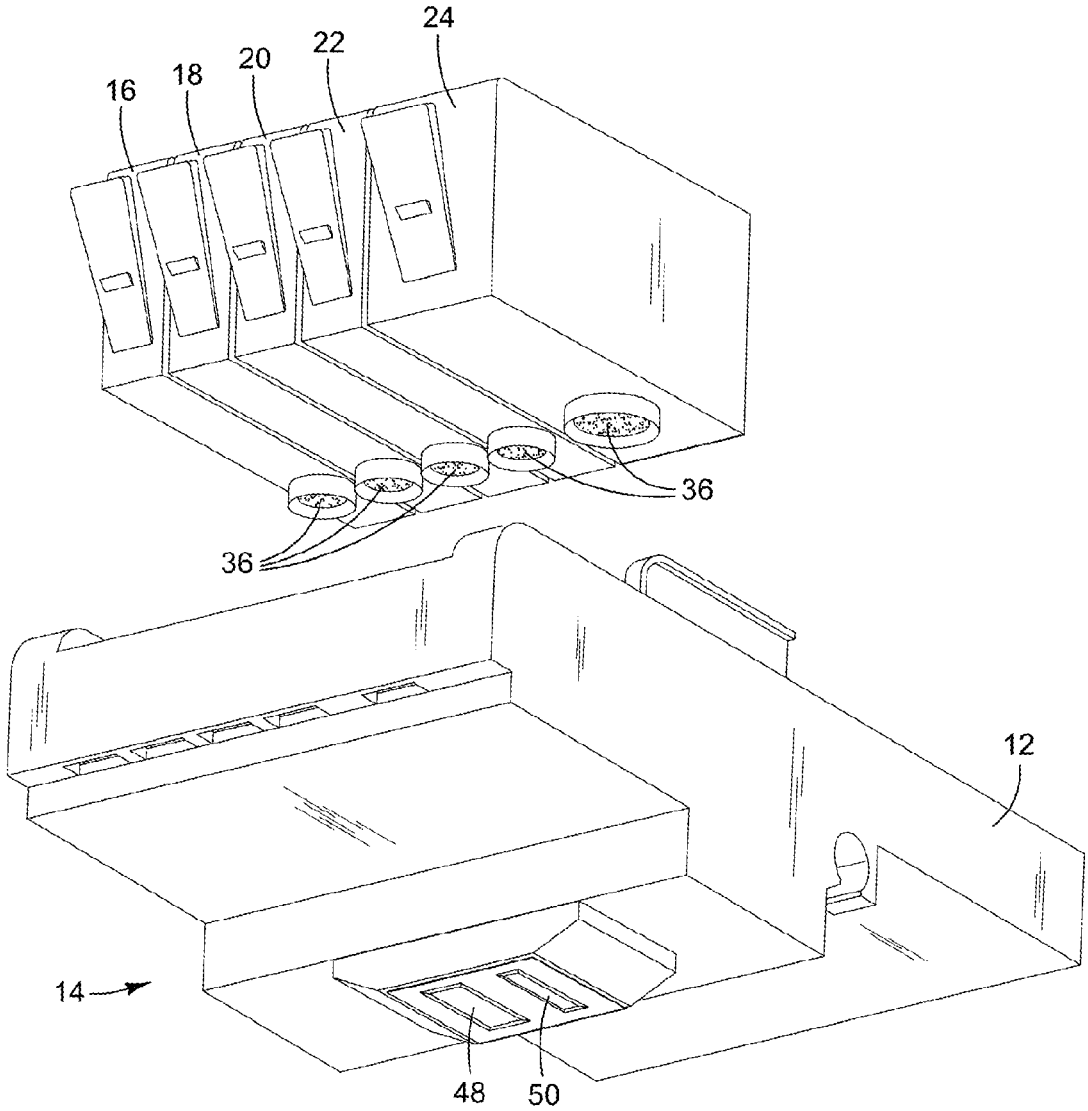

FIGS. 2 and 3 are perspective views of one embodiment of a carriage 12 and printhead assembly 14 in printer 10. Ink containers 16-24 are exploded out from carriage 12 to show ink inlets 34 to printhead assembly 14 (FIG. 2) and ink outlets 36 from ink containers 16-24 (FIG. 3). Referring to FIG. 2, printhead assembly 14 includes an ink inlet 34 positioned at each bay 38, 40, 42, 44, and 46 for a corresponding ink container 16-24. Printhead assembly 14 and carriage 12 may be integrated together as a single part or printhead assembly 14 may be detachable from carriage 12. For a detachable printhead assembly 14, container bays 38-46 may extend out into carriage 12 as necessary or desirable to properly receive and hold containers 16-24.

Referring to FIG. 3, in the embodiment shown, printhead assembly 14 includes two printheads 48 and 50. Ink from color ink containers 16-22, for example, is ejected from printhead 48 and ink from a black container 24 is ejected from printhead 50. Each ink container 16-24 includes an ink outlet 36 through which ink may flow from container 16-24 through an inlet 34 (FIG. 2) to a corresponding printhead 48 or 50 in printhead assembly 14.

Figure 4:
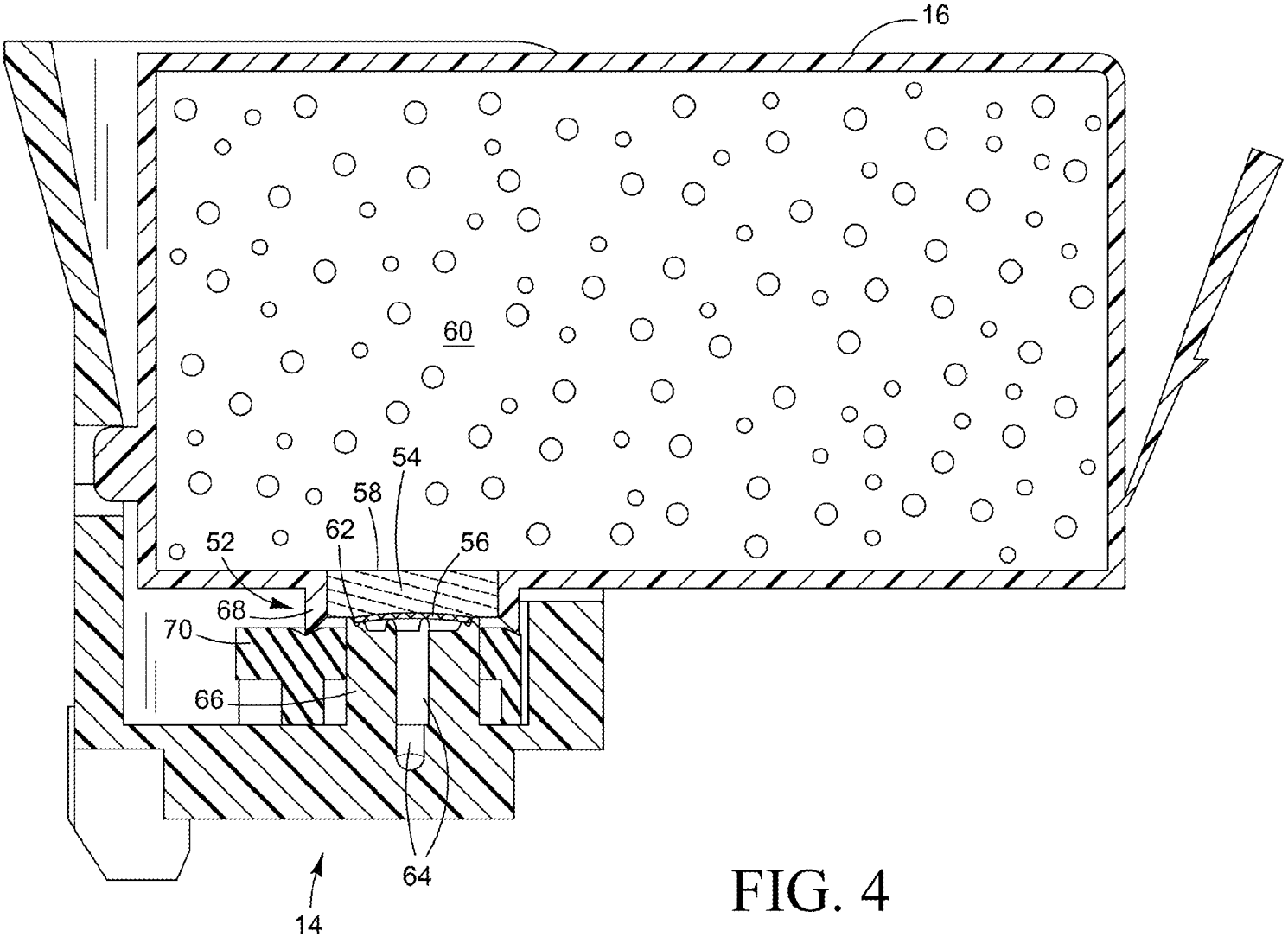
FIG. 4 is an elevation section view illustrating a fluid interconnection between an ink container and the printhead assembly according to an embodiment of the disclosure.

FIG. 4 is an elevation section view showing one embodiment of a fluid interconnection 52 between an ink container 16 and printhead assembly 14. Referring to FIG. 4, fluid interconnection 52 includes a wick 54 in container outlet structure 68 and a filter 56 at printhead assembly inlet structure 66. An upstream surface 58 of outlet wick 54 contacts foam or other ink holding material 60 in container 16. Alternatively, where an ink container 16 holds so-called "free ink", and there is no ink holding material, then upstream surface 58 will be exposed to the free ink in container 16. A downstream surface 62 of outlet wick 54 and filter 56 are in contact with one another when container 16 is installed in printhead assembly 14 as shown in FIG. 4. An ink channel 64 downstream from filter 56 carries ink to printhead 48 (not shown). Inlet structure 66 is sometimes referred to as an inlet "tower" 66 because it usually extends out from the surrounding structure. Container outlet structure 68 fits around inlet tower 66 and seals against an elastomeric gasket or other suitable seal 70 to help prevent air from entering fluid interconnection 52.

Figure 5:
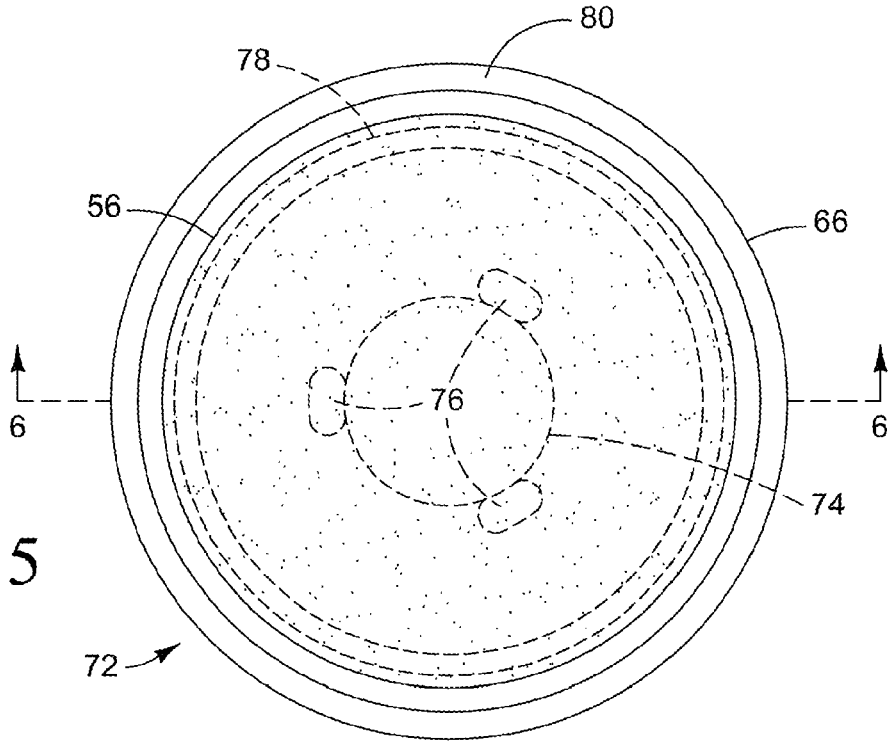
FIGS. 5 and 6 are plan and section views, respectively, illustrating the placement of a filter on an inlet structure for a printhead assembly before the filter is secured to the inlet structure.
Figure 6:
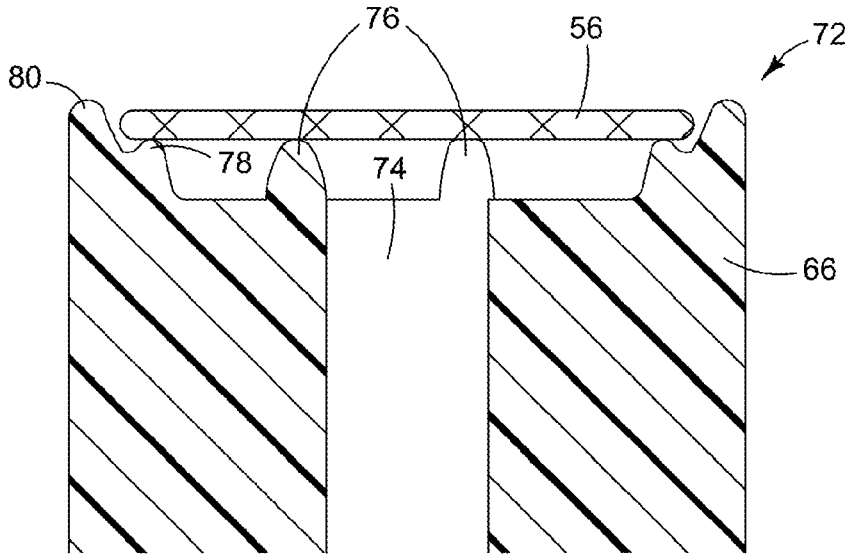

FIGS. 5 and 6 are plan and section views, respectively, illustrating the placement of a filter 56 on an inlet tower 66 before the filter 56 is secured to tower 66. (Filter 56 in the plan view of FIG. 5 is depicted with stippling and the underlying structure shown with solid lines for clarity.) FIGS. 7-10 are section views illustrating a new method for securing filter 56 to tower 66, according to one embodiment of the disclosure. Referring first to FIGS. 5 and 6, a filter 56 is placed over the exposed, top end 72 of tower 66, covering an opening 74 in tower 66 such that ink passing through opening 74 to ink channel 64 (FIG. 4) must first pass through filter 56. Top end 72 of tower 66 includes a series of three protrusions 76, sometimes referred to as dome retention posts, positioned around opening 74 to support the central portion of filter 56. Top end 72 also includes a ridge 78 inside a peripheral rim 80.

Figure 7:
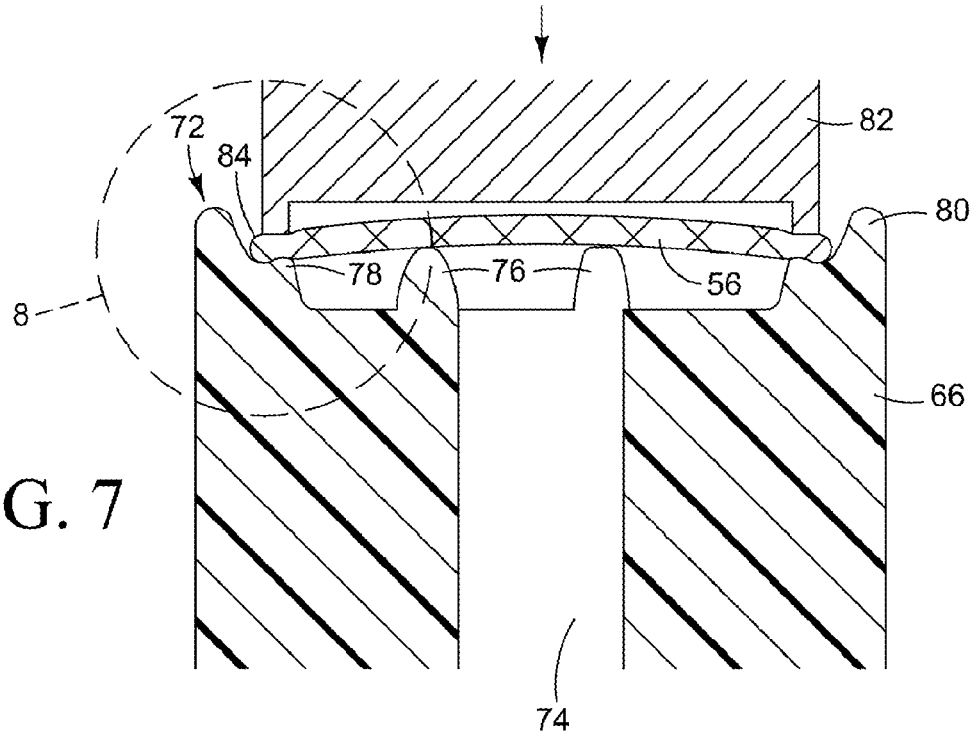
FIGS. 7-10 are section views illustrating a method for securing the filter to the inlet structure according to an embodiment of the disclosure.
Figure 8:
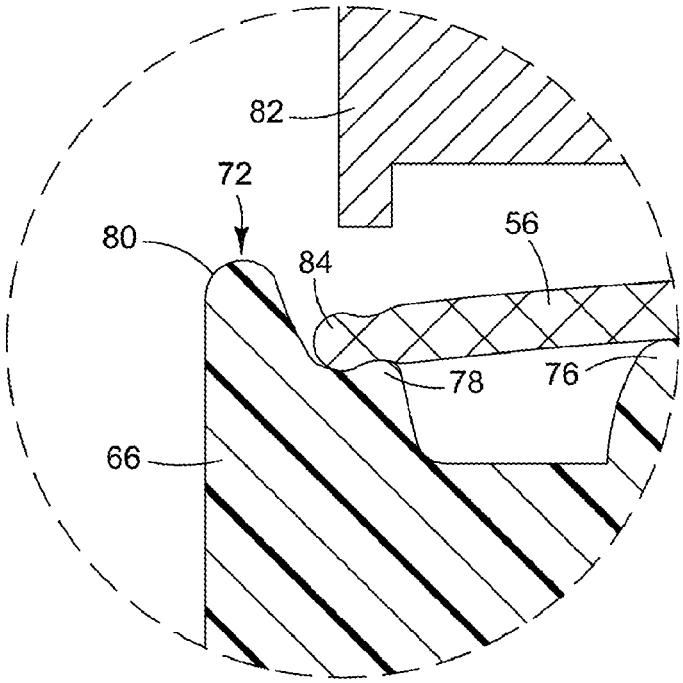

Referring now to FIGS. 7 and 8, a heated die or other suitable staking tool 82 stakes an outer peripheral edge 84 of filter 56 to tower top end 72 along ridge 78. Staking die 82 is shown in contact with filter 56 in FIG. 7 and withdrawn slightly from filter 56 in FIG. 8. The staking operation illustrated in FIGS. 7 and 8 is a conventional operation commonly used to attach a filter to an inlet tower in an inkjet print cartridge or an inkjet printhead assembly. A heated die or an ultrasonic welding horn are two staking tools often used to attach a filter 56. In either case, the staking tool 82 softens the plastic tower at ridge 78, sometimes referred to as an energy director, so that the filter mesh is pressed into the softened plastic, thus "staking" the filter in place on tower 66. Staking filter 56 in this manner, however, leaves filter edge 84 exposed and subject to damage by container outlet structure 68 and/or wick 54 (FIG. 4) when a container 16 (FIG. 4) is installed into and removed from printhead assembly 14 (FIG. 4).

Figure 9:
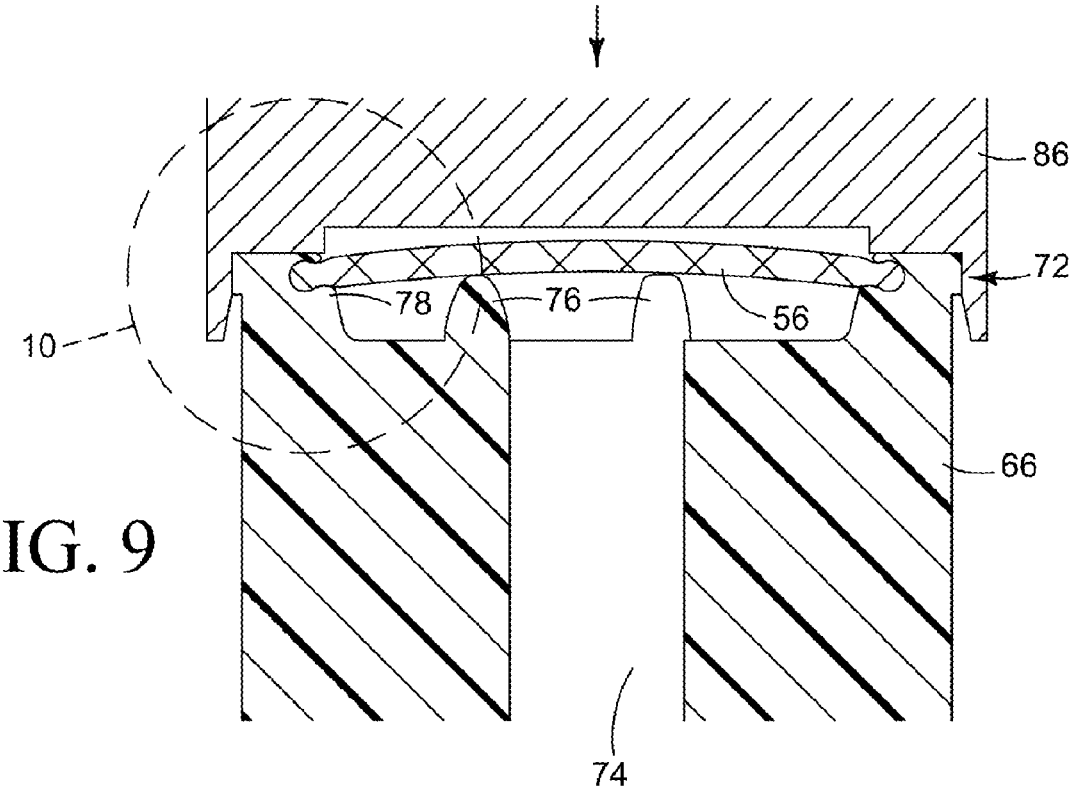
Figure 10:
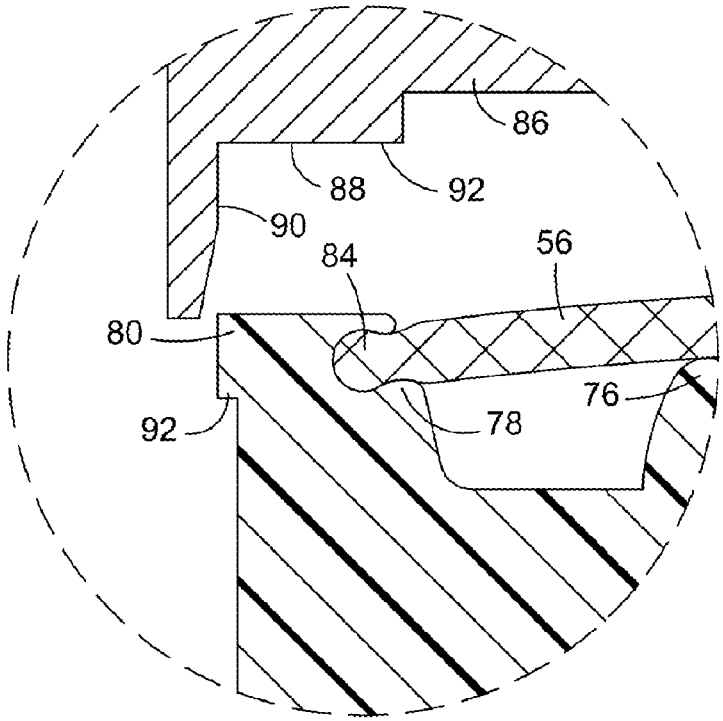

Thus, a second operation, shown in FIGS. 9 and 10, is performed to encapsulate filter edge 84 and protect it from damage. Referring now to FIGS. 9 and 10, a heated die or other suitable shaping tool 86 contours tower rim 80 to encapsulate outer peripheral edge 84 of filter 56, as best seen by comparing FIGS. 8 and 10. Shaping die 86 is shown in contact with filter 56 in FIG. 9 and withdrawn slightly from filter 56 in FIG. 10. In the embodiment shown in FIGS. 9-10, as best seen in FIG. 10, a face 88 of shaping die 86 extends inward past filter edge 84 at a right angle, sharp corner to a projecting side 90 that extends down along the top end 72 of tower 66 as die 86 is brought into contact with tower rim 80. A heated die or an ultrasonic welding horn, for example, are tools that may be used to encapsulate filter edge 84. In either case, the tool 86 softens the plastic tower rim 80 so that the softened plastic flows into and encapsulates filter edge 84. If desirable, die 86 may be configured to push a small portion of tower rim 80 down along projecting side 90 to form a barb 92 around the outer rim of tower top end 72. Barb 90 may be used to help retain seal 70 (FIG. 4) in place around tower 66.

Figure 11:
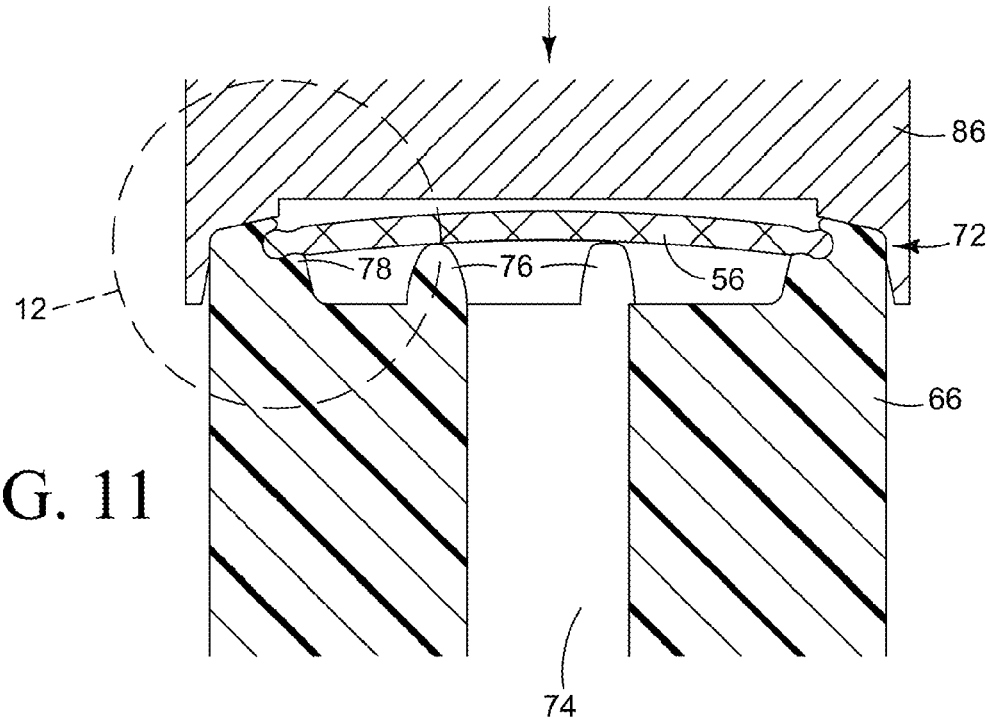
FIGS. 11 and 12 are section views illustrating another embodiment of a second operation for encapsulating the rim of the filter.
Figure 12:
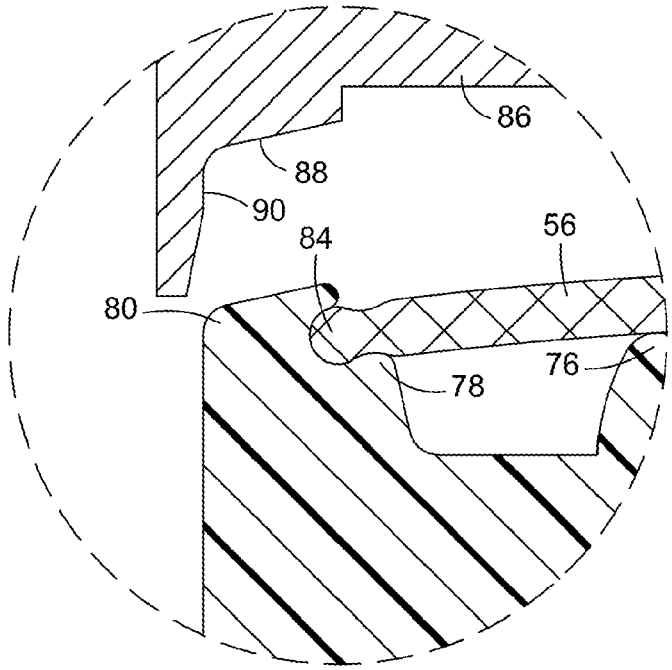

In an alternative embodiment of the second operation, shown in FIGS. 11 and 12, die face 88 extends inward at an obtuse angle, rounded corner to projecting side 90. Also, die face 88 in FIGS. 11 and 12 is slightly wider so that it slides along the outside of tower top end 72 to not form a barb.

Figure 13:
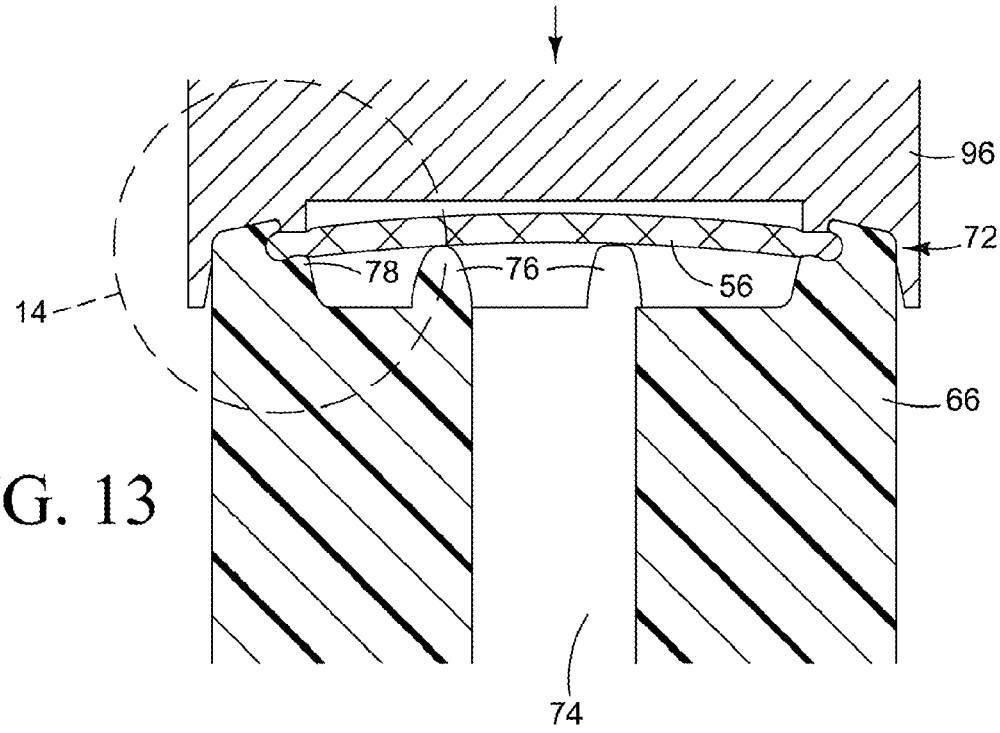
FIGS. 13 and 14 are section views illustrating another method for securing the filter to the inlet structure according to an embodiment of the disclosure in which the filter is secured and the edge encapsulated in a single operation.
Figure 14:
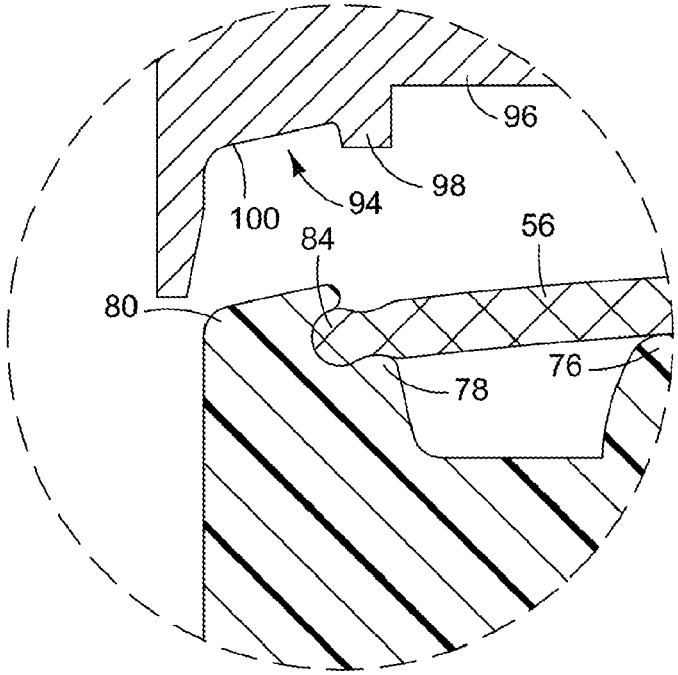

FIGS. 13 and 14 are section views illustrating another method for securing filter 56 to tower 66 in which the filter is secured in a single operation. Referring to FIGS. 13 and 14, the face 94 of a heated die or other suitable tool 96 is configured to simultaneously stake filter edge 84 to tower top end 72 along ridge 78 and contour tower rim 80 to encapsulate edge 84 within rim 80. After filter 56 is placed on tower 66 as shown in FIG. 6 and die 96 is pressed onto tower top end 72, a staking part 98 of die face 94 stakes filter edge 84 to tower top end 72 (as described above with regard to FIGS. 7 and 8) while an encapsulating part 100 contours rim 80 in to encapsulate filter edge 84. Upon release of die 96, as shown in FIG. 14, filter edge 84 is staked to tower top end 72 along ridge 78 and encapsulated with the plastic tower material pushed in from rim 80. Simultaneously staking and encapsulating helps prevent the formation of gaps, pockets, recesses or the like at filter edge 84 during encapsulation because the staking part 98 of die face 94 is pressed into and holds filter 56 against tower top end 72 simultaneously with encapsulating edge 84. A similar advantage may be gained in the dual operation method described above with reference to FIGS. 9-12 by configuring the shaping die to press down on filter 56 at the same time material from tower rim 80 is pushed in to encapsulate filter edge 84.

Die faces 88 and 94 shown in FIGS. 9-14 are just three examples of suitable die face configurations. Die face configurations may be varied, for example, according to the pre-formed/beginning structure of tower top end 72 and the desired post-formed height and shape of tower rim 80. The pre-formed/beginning configuration of tower top end 72 shown in FIG. 6 is just one possible starting configuration. The particular tower configuration shown in FIG. 6, which represents a conventional configuration already in use, is depicted to illustrate that embodiments of the new methods may be used with a conventional tower structure. In both method embodiments described above, the plastic of tower rim 80 is shaped down and inward to fill any gaps between filter edge 84 and rim 80. The post-formed rim 80 may have a lower profile, as shown, to be more in line with filter edge 84. The tower geometry, including the height, thickness and shape of tower rim 80, may be optimized for the diameter and thickness of filter 56 to help ensure an adequate volume of plastic is available to flow into and around filter edge 84.

As noted at the beginning of this Description, the example embodiments shown in the figures and described above illustrate but do not limit the disclosure. Other forms, details, and embodiments may be made and implemented. Therefore, the foregoing description should not be construed to limit the scope of the disclosure, which is defined in the following claims.

What is claimed is:

1. A fluid ejector assembly, comprising:

an inlet structure having an opening therein through which fluid may enter the assembly, the inlet structure having a rim generally defining an outer perimeter of the inlet structure around the opening;

a conduit through which fluid may pass from the opening in the inlet structure to an ejector structure; and a filter supported on the inlet structure and spanning the opening such that fluid passing through the opening in the inlet structure to the conduit passes through the filter, a peripheral edge of the filter surrounded by the rim of the inlet structure and the peripheral edge of the filter encapsulated by the inlet structure, wherein the rim integrally extends as a single unitary body along a side of the peripheral edge of the filter and over a top of the peripheral edge of the filter.

2. The assembly of claim 1, wherein the filter is staked to the inlet structure at or near the peripheral edge of the filter.

3. The assembly of claim 1, wherein the filter is staked to the inlet structure at or near the peripheral edge of the filter and the peripheral edge of the filter is fully encapsulated by the rim of the inlet structure such that there are no gaps or cavities in that part of the inlet structure encapsulating the peripheral edge of the filter.

4. The assembly of claim 1, wherein the filter comprises a mesh and a material comprising the rim of the inlet structure impregnates the mesh along the peripheral edge of the filter.

5. The assembly of claim 4, wherein the rim material comprises a flowable material filter impregnating the mesh along the edge of the filter.

6. A method of assembling an inlet structure for a fluid ejector assembly, the inlet structure including a tower having an opening therein through which fluid may enter the ejector assembly, the method comprising:

placing a filter on the tower such that the filter covers the opening and a rim of the tower surrounds a peripheral edge of the filter;

staking the filter to the tower along or near the peripheral edge of the filter; and then encapsulating the peripheral edge of the filter in the rim of the tower, wherein the encapsulating comprises bending the rim of the tower around the peripheral edge of filter such that the tower integrally extends as a single unitary body from below, along sides of, and over a top of the peripheral edge of the filter.

7. The method of claim 6, wherein staking and bending are performed in the same operation.

8. The method of claim 6, wherein staking and bending are performed simultaneously in a single operation.

9. A method of assembling an inlet structure for an ink ejector assembly, the inlet structure including a tower comprising flowable material, the tower having an opening therein through which ink may enter the ejector assembly, the method comprising:

covering the opening with a filter; and encapsulating a peripheral edge of the filter in the flowable tower material, wherein the encapsulating comprises:

flowing a rim of the tower into the edge of the filter; and heating the rim and pressing it over the edge of the filter.

10. The method of claim 9, further comprising staking the filter to the tower.

11. The method of claim 10, wherein staking and encapsulating are performed in the separate operations.

12. The method of claim 10, wherein staking and encapsulating are performed simultaneously in a single operation.

13. The method of claim 9, wherein encapsulating a peripheral edge of the filter in the flowable tower material comprises simultaneously applying pressure to the peripheral edge of the filter and encapsulating the peripheral edge of the filter in the tower.

14. The assembly of claim 1, wherein the inlet structure has a ridge upon which the filter extends and wherein the ridge and the rim are integrally formed as a single unitary body such that the inlet structure integrally extends as a single unitary body from below, along a side of and over a top of the peripheral edge of the filter.

15. The assembly of claim 1 further comprising:

a seal around and about an exterior of the inlet structure outside and below the rim; and an ink container above the rim, the ink container bearing against the seal.

16. The assembly of claim 15 further comprising a barb around the rim and retaining the seal.

17. The assembly of claim 1, wherein the inlet structure comprises a plurality of protrusions projecting above a mouth of the opening about the opening, the protrusions supporting a central portion of the filter.

18. The assembly of claim 1, wherein the rim of the inlet structure bends around the peripheral edge of the filter over the peripheral edge of the filter.

19. The method of claim 6 further comprising supporting a central portion of the filter with a plurality of protrusions projecting above a mouth of the opening.

20. The method of claim 6 further comprising:

positioning a seal around and about an exterior of the inlet structure outside and below the rim; and positioning an ink container above the rim, the ink container bearing against the seal.

* * * * *